US005350541A

United States Patent [19]

Michael et al.

[11] Patent Number: 5,350,541

[45] Date of Patent: Sep. 27, 1994

[54] HARD SURFACE DETERGENT COMPOSITIONS

[75] Inventors: Daniel W. Michael, Cincinnati; Michael S. Maile, Maineville, both of Ohio

[73] Assignee: The Procter & Gamble Company, Cincinnati, Ohio

[21] Appl. No.: 928,255

[22] Filed: Aug. 11, 1992

Related U.S. Application Data

[63] Continuation-in-part of Ser. No. 744,848, Aug. 14, 1991, abandoned.

[51] Int. Cl.[5] ..... C11D 1/83; C11D 7/50

[52] U.S. Cl. ..... 252/549; 252/550; 252/162; 252/174.21; 252/DIG. 14

[58] Field of Search ..... 252/549, 550, 162, 170, 252/174.21, 174.11, DIG. 14

[56] References Cited

U.S. PATENT DOCUMENTS

| | | | |
|---|---|---|---|
| 3,882,038 | 5/1975 | Clayton et al. | 252/164 |
| 4,576,738 | 3/1986 | Colodney et al. | 252/559 |
| 4,692,277 | 9/1977 | Siklosi | 252/558 |
| 4,769,169 | 9/1988 | Fishlock-Lomax | 252/106 |
| 4,769,172 | 9/1988 | Siklosi | 252/153 |
| 4,810,421 | 3/1989 | Marchesini | 252/546 |
| 4,863,629 | 9/1989 | Osberghaus et al. | 252/162 |
| 4,869,842 | 9/1989 | Denis et al. | 252/121 |
| 4,948,531 | 8/1990 | Fuggini et al. | 252/544 |
| 5,075,026 | 12/1991 | Loth et al. | 252/122 |

FOREIGN PATENT DOCUMENTS

| | | | |
|---|---|---|---|
| 3834181A | 4/1990 | Fed. Rep. of Germany | C11D 1/22 |
| 1182400A | 7/1989 | Japan | C11D 3/18 |

*Primary Examiner*—Prince Willis, Jr.
*Assistant Examiner*—J. Silbermann
*Attorney, Agent, or Firm*—Robert B. Aylor

[57] ABSTRACT

Detergent compositions comprising nonionic detergent surfactant; hydrophobic cleaning solvent; and suds control system comprising fatty acid and anionic sulfonated and/or sulfated detergent surfactant. The compositions are preferably in the form of aqueous liquids and preferably have monoethanolamine and/or beta-aminoalkanol present.

20 Claims, No Drawings

HARD SURFACE DETERGENT COMPOSITIONS

CROSS-REFERENCE TO RELATED APPLICATION

This is a continuation-in-part application of U.S. Ser. No. 07/744,848, filed Aug. 14, 1991 now abandoned.

FIELD OF THE INVENTION

This invention pertains to detergent compositions for hard surfaces. Such compositions typically contain detergent surfactants, detergent builders, and/or solvents to accomplish their cleaning tasks.

BACKGROUND OF THE INVENTION

The use of hard surface cleaning compositions containing organic water-soluble synthetic detergents, solvents, and, optionally, detergent builders are known. However, such compositions often have sudsing characteristics that are not optimum.

An object of the present invention is to provide detergent compositions which provide both (a) good cleaning for all of the usual hard surface cleaning tasks found in the home and (b) preferred sudsing characteristics.

SUMMARY OF THE INVENTION

The present invention relates to a hard surface detergent composition, preferably aqueous, comprising: (a) nonionic detergent surfactant; (b) hydrophobic solvent that provides a primary cleaning function; (c) suds control system comprising low level of fatty acid and anionic detergent surfactant; and (d) the balance typically being an aqueous solvent system and minor ingredients, said composition having a pH of from about 6.0 to about 12.5, preferably from about 8.5 to about 11.5, more preferably from about 10 to about 11.5. The compositions can also contain, optionally, small amounts of additional surfactants and/or polycarboxylate detergent builders and/or buffering system (to maintain the desired pH). The compositions can be formulated either as concentrates, or at usage concentrations and can be packaged in a container having means for creating a spray to make application to hard surfaces more convenient.

DETAILED DESCRIPTION OF THE INVENTION

(a) The Nonionic Detergent Surfactant

In accordance with the present invention, it has been found that nonionic detergent surfactants, which provide superior cleaning on oily/greasy soils, have a sudsing profile that is more optimal than anionic surfactants, however, it is too high for optimum acceptance by the consumer.

The nonionic detergent surfactant provides the main cleaning and emulsifying benefits herein. Nonionic detergent surfactants useful herein include any of the well-known nonionic detergent surfactants that have an HLB of from about 6 to about 18, preferably from about 8 to about 16, more preferably from about 10 to about 15. Typical of these are alkoxylated (especially ethoxylated) alcohols and alkyl phenols, and the like, which are well-known from the detergency art. In general, such nonionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8 , ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include decyl polyethoxylate(2.5); coconut alkyl polyethoxylate(6.5); and decyl polyethoxylate(6).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic detergent surfactant typically comprises from about 1% to about 15%, preferably from about 2% to about 10%, more preferably from about 2.5% to about 5%.

(b) The Hydrophobic Solvent

In order to obtain good cleaning, especially of lipid soils, it is necessary to use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry. The level of hydrophobic solvent is typically from about 0.5% to about 15%, preferably from about 1% to about 12%, most preferably from about 2% to about 10%.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ g alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^1O(R^2O)_mH$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

The butoxy-propanol solvent should have no more than about 20%, preferably no more than about 10%, more preferably no more than about 7%, of the secondary isomer in which the butoxy group is attached to the secondary atom of the propanol for improved odor.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$ |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements. All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Other solvents such as benzyl alcohol, n-hexanol, and phthalic acid esters of $C_{1-4}$ alcohols can also be used.

Terpene solvents and pine oil, are usable, but are preferably not present.

(c) The Suds Control System

(1) The Fatty Acid

The primary suds controlling ingredient is fatty acid containing from about 8 to about 22, preferably from about 10 to about 18, more preferably from about 10 to about 16, carbon atoms. Especially preferred fatty acids are derived from, e.g., coconut oil, palm kernel oil, and animal tallow.

The level of such fatty acid is from about 0.01% to about 0.3%, preferably from about 0.02% to about 0.20%, more preferably from about 0.02% to about 0.15%, for normal concentrations of nonionic detergent surfactant as set forth hereinbefore. Less fatty acid is needed for lower HLB nonionic detergent surfactants and more is needed for higher HLB nonionic detergent surfactants. Preferably the level of fatty acid is kept below about 0.1% in order to maintain superior spotting/filming performance. The ratio of nonionic detergent surfactant to fatty acid typically ranges from about 10:1 to about 120:1, preferably from about 20:1 to about 80:1.

The fatty acid does not control the suds of the nonionic detergent surfactant if it is used alone. Surprisingly, the fatty acid requires the presence of a small amount of anionic synthetic detergent surfactant, preferably a sulfonated or sulfated synthetic detergent surfactant, more preferably a sulfonated detergent surfactant as set forth hereinafter.

(2) The Anionic Sulfated or Sulfonated Detergent Surfactant

Typical synthetic anionic sulfated and/or sulfonated detergent surfactants are the alkyl- and alkylethoxylate(polyethoxylate) sulfates, paraffin sulfonates, alkyl benzene sulfonates, olefin sulfonates, alpha-sulfonates of fatty acids and of fatty acid esters, and the like, which are well known from the detergency art. In general, such detergent surfactants contain an alkyl group in the $C_9$–$C_{22}$, preferably $C_{10-18}$, more preferably $C_{12-16}$, range. The anionic detergent surfactants can be used in the form of their sodium, potassium or alkanolammonium, e.g., triethanolammonium salts. $C_{12}$–$C_{18}$ paraffin-sulfonates and $C_{9-15}$ alkyl benzene sulfonates are especially preferred in the compositions of the present type. Although alkyl sulfates are not very efficient, alkyl ethoxylate sulfates are relatively efficient.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The anionic detergent cosurfactant component is typically present at a level of from about 0.1% to about 3.5%, more preferably from about 0.25% to about 1%. Anionic detergent surfactants are desirably present in limited amounts to promote rinsing of the surfaces. However, the level of synthetic anionic detergent surfactant should be less than about one half of the nonionic detergent surfactant.

It has been surprisingly found that the ratio of anionic surfactant to fatty acid is particularly critical in the control of sudsing. Preferably the ratio of anionic to fatty acid ranges from about 20:1 to about 3:1, more preferably the ratio lies between about 12:1 and about 4:1.

(d) Optional Monoethanolamine and/or Beta-aminoalkanol

Monoethanolamine and/or beta-aminoalkanol compounds serve primarily as solvents when the pH is above about 10, and especially above about 10.7. They also provide alkaline buffering capacity during use. However, the most unique contribution they make is to improve the spotting/filming properties of hard surface cleaning compositions. The reason for the improvement is not known. It is not simply a pH effect, since the improvement is not seen with conventional alkalinity sources. Other similar materials that are solvents do not provide the same benefit and the effect can be different depending upon the other materials present. When perfumes that have a high percentage of terpenes are incorporated, the benefit is greater for the beta-alkanolamines, and they are often preferred, whereas the monoethanolamine is usually preferred.

Monoethanolamine and/or beta-alkanolamine, when present, are used at a level of from about 0.05% to about 10%, preferably from about 0. 2% to about 5%. For dilute compositions they are typically present at a level of from about 0.05% to about preferably from about 0.1% to about 1%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

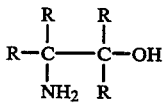

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino, 1 -butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. Polar solvents with only minimal cleaning action like methanol, ethanol, isopropanol, ethylene glycol, propylene glycol, and mixtures thereof are usually not present. When the nonaqueous solvent is present, the level of nonaqueous polar solvent is from about 0.5% to about 10%, preferably less than about 5% and the level of water is from about 50% to about 97%, preferably from about 75% to about 95%.

(e) Optional Ingredients

The compositions herein can also contain other various adjuncts which are known to the art for detergent compositions so long as they are not used at levels that cause unacceptable spotting/filming. Nonlimiting examples of such adjuncts are:

- Low levels of other detergent surfactants, e.g., zwitterionic detergent surfactants, and detergent builders;
- Enzymes such as proteases;
- Hydrotropes such as sodium toluene sulfonate, sodium cumene sulfonate and potassium xylene sulfonate; and
- Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Zwitterionic Detergent Surfactants

Zwitterionic detergent surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used. A generic formula for some preferred zwitterionic detergent surfactants is:

$$R—N^{(+}(R^2)(R^3)R^4X^{-)}$$

wherein R is a hydrophobic group; $R^2$ and $R^3$ are each $C_{1-4}$alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl)-2-hydroxy-propane-1-sulfonate, available from the Sherex Company under the trade name "Varion HC".

Other specific zwitterionic detergent surfactants have the generic formula:

$$R—C(O)—N(R^2)—(CR^3{}_2)_n—N(R^2)_2{}^{+}—(CR^3{}_2)hd\ n—SO_3{}^{-)}$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10-14}$ fatty acylamidopropylene(hydroxypropylene)sulfobetaine that is available from the Sherex Company under the trade name "Varion CAS Sulfobetaine".

Compositions of this invention containing the above hydrocarbyl amido sulfobetaine (HASB) can contain more perfume and/or more hydrophobic perfumes than similar compositions containing conventional anionic detergent surfactants. This can be desirable in the preparation of consumer products. Perfumes useful in the compositions of this invention are disclosed in more detail hereinafter.

Other zwitterionic detergent surfactants useful herein include hydrocarbyl, e.g., fatty, amidoalkylenebetaines (hereinafter also referred to as "HAB"). These detergent surfactants have the generic formula:

$$R—C(O)—N(R^2)—(CR^3{}_2)_n13 \; N(R^2)_2(^+)—(CR^3{}_2)_n—C(O)O(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine BD".

The level of zwitterionic detergent surfactant in the composition is typically from 0% to about 0.5%, preferably from about 0.02% to about 0.5%, more preferably from about 0.05% to about 0.25%.

Polycarboxylate Detergent Builders

Polycarboxylate detergent builders useful herein, include the builders disclosed in U.S. Pat. No. 4,915,854, Mao et al., issued Apr. 10, 1990, and incorporated herein by reference. Suitable detergent builders preferably have relatively strong binding constants for calcium. Preferred detergent builders include citrates and, especially, builders whose acids have the generic formula:

$$R^5—[O—CH(COOH)CH(COOH)]_nR^5$$

wherein each $R^5$ is selected from the group consisting of H and OH and n is a number from about 2 to about 3 on the average. Other preferred detergent builders include those described in the copending U.S. Pat. application Ser. No. 285,337 of Stephen Culshaw and Eddy Vos for "Hard-Surface Cleaning Compositions," filed Dec. 14, 1988, said patent application being incorporated herein by reference.

In addition to the above detergent builders, other detergent builders that are relatively efficient for hard surface cleaners and/or, preferably, have relatively reduced filming/streaking characteristics include those disclosed in U.S. Pat. No. 4,769,172, Siklosi, issued Sep. 6, 1988, and incorporated herein by reference. Still others include the chelating agents having the formula:

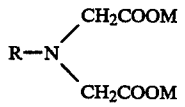

wherein R is selected from the group consisting of: $—CH_2CH_2CH_2OH$; $—CH_2CH(OH)CH_3$; $—CH_2CH(OH)CH_2OH$; $—CH(CH_2OH)_2$; $—CH_3$; $—CH_2CH_2OCH_3$;

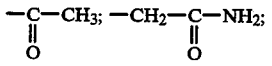

$—CH_2CH_2CH_2OCH_3$; $—C(CH_2OH)_3$; and mixtures thereof; and each M is hydrogen.

Chemical names of the acid form of the chelating agents herein include:

N(3-hydroxypropyl)imino-N,N-diacetic acid (3-HPIDA);
N(-2-hydroxypropyl)imino-N,N-diacetic acid (2-HPIDA);
N-glycerylimino-N,N-diacetic acid (GLIDA);
dihydroxyisopropylimino-(N,N)-diacetic acid (DHPIDA);
methylimino-(N,N)-diacetic acid (MIDA);
2-methoxyethylimino-(N,N)-diacetic acid (MEIDA);
amidoiminodiacetic acid (also known as sodium amidonitrilotriacetic, SAND);
acetamidoiminodiacetic acid (AIDA);
3-methoxypropylimino-N,N-diacetic acid (MEPIDA); and
tris(hydroxymethyl)methylimino-N,N-diacetic acid (TRIDA).

Methods of preparation of the iminodiacetic derivatives herein are disclosed in the following publications:
Japanese Laid Open publication 59-70652, for 3-HPIDA;
DE-OS-25 42 708, for 2-HPIDA and DHPIDA;
Chem. ZVESTI 34(1) p. 93–103 (1980), Mayer, Riecanska et al., publication of Mar. 26, 1979, for GLIDA;
C.A. 104(6)45062 d for MIDA; and
Biochemistry 5, p. 467 (1966) for AIDA.

The chelating agents of the invention, when they are present, are at levels of from about 0.5% to about 15.0% of the total composition, preferably about 1.0% to about 10%., more preferably from about 1.0% to about 5.0%.

The detergent builders can help provide the desired pH in use. However, if necessary, the composition can also contain additional buffering materials to give the desired pH in use. pH is usually measured on the product.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are readily solubilized in the compositions by the nonionic and zwitterionic detergent surfactants. Anionic detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aidehyde), gammamethyl ionone, nerolidol, patchouli alcohol, phenyl hexanol, betaselinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl -cyclopenta-gama-2-benzopyran), hexyl cinnamic aidehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions.

These compositions have exceptionally good cleaning properties. They also have good "shine" properties, i.e., when used to clean glossy surfaces, without rinsing, they have much less tendency than e.g., phosphate built products to leave a dull finish on the surface.

The product can be packaged in a container that comprises a means for creating a spray, e.g., a pump, aerosol propellant and spray valve, etc.

All parts, percentages, and ratios herein are "by weight" unless otherwise stated. All numerical values are approximations unless otherwise stated.

The invention is illustrated by the following Examples.

| | EXAMPLES 1–3 | | | EXAMPLES 4 & 5 | |
|---|---|---|---|---|---|
| Example No.: Ingredient | 1* Wt. % | 2 Wt. % | 3 Wt. % | 4 Wt. % | 5* Wt. % |
| Neodol 23-6.5T [$C_{12-13}$ alkyl polyethoxylate (6.5)] | 2.5 | 2.5 | 2.5 | 2.5 | 2.5 |
| Dipropylene Glycol Monobutyl Ether | 3.0 | 3.0 | 3.0 | 3.0 | 3.0 |
| Monoethanolamine | 0.5 | 0.5 | 0.5 | 0.5 | 0.5 |
| Sodium Dodecylbenzene Sulfonate | 0.5 | 0.5 | 0.5 | 0.5 | 0.5 |
| Coconut Fatty Acid | — | 0.03 | 0.06 | 0.09 | 0.12 |
| Deionized Water and Minors (e.g., Perfume) | q.s. | q.s. | q.s. | q.s. | q.s. |
| pH | 10.8 | 10.7 | 10.6 | 10.6 | 10.5 |

*Comparative Example.

Bucket Suds Method

A sponge mop head is thoroughly cleaned and rinsed in warm tap water. One gallon (~4 liters) of 110° F. (~43° C.) city tap water (typically 8–9 grains of $CaCO_3$ hardness) is poured into a clear plastic bucket. One quarter cup (~0.059 liter) of test product is added. The sponge mop is inserted into the clear bucket plunged down into the bucket and lifted out of the bucket. This step is repeated twice. After three separate plunges, the mop is lifted out and squeezed allowing the water and suds to fall in the middle of the bucket. This sequence of 3 plunges and 1 squeeze is repeated. Immediately, 3 separate suds height measurements are taken and recorded. The bucket should sit undisturbed for 2 minutes to allow for the dissipation of the suds. The suds height is again measured at 3 separate points and recorded.

Suds Height Data
(Heights in mm, Average of Three Measurements)

| Example No. | Initial Suds Height | Suds Height after 2 Minutes (Measure of Prompt Dissipation of Suds) |
|---|---|---|
| 1 | 38 | 29 |
| 2 | 29 | 15 |
| 3 | 23 | 11 |
| 4 | 19 | 1 |

-continued

| Suds Height Data (Heights in mm, Average of Three Measurements) | | |
|---|---|---|
| Example No. | Initial Suds Height | Suds Height after 2 Minutes (Measure of Prompt Dissipation of Suds) |
| 5 | 16 | — |

Consumer acceptance testing has indicated that some bucket suds must remain after about two minutes of use. Therefore, Comparative Example 5 has too much suds suppression and is unacceptable. Example 4 is very nearly the same as Comparative Example 5 and is not a preferred execution of the invention. Example 3 is the most preferred level of suds suppression. Example 2 has an acceptable level of suds suppression. Comparative Example 1 is not acceptable because of very low suds dissipation at the two minute (dissipation) interval.

What is claimed is:

1. A hard surface detergent composition comprising: (a) from about 1% to about 15% of nonionic detergent surfactant; (b) from about 0.5% to about 15% of hydrophobic solvent that provides a cleaning function; (c) suds control system comprising from about 0.01% to about 0.3% fatty acid and from about 0.1% to about 3.5% sulfonated and/or sulfated synthetic anionic detergent surfactant the ratio of nonionic detergent surfactant to fatty acid being from about 10:1 to about 120:1 and the level of said sulfonated and/or sulfated synthetic detergent surfactant to fatty acid being from about 15:1 to about 5:1; and (d) the balance being an aqueous solvent system and minor ingredients, the pH of said composition being from about 6.0 to about 12.5.

2. The composition of claim 1 wherein said nonionic detergent surfactant is a fatty alcohol containing from about 8 to about 14 carbon atoms ethoxylated with from about 2 to about 10 moles of ethylene oxide per mole of fatty alcohol.

3. The composition of claim 2 wherein said nonionic detergent surfactant has an HLB of from about 7 to about 14.

4. The composition of claim 3 containing from about 1% to about 15% of said organic solvent (b), said solvent having a solubility in water of less than about 20%.

5. The composition of claim 4 wherein said hydrophobic solvent (b) is selected from the group consisting of alkyl and cycloalkyl hydrocarbons and halohydrocarbons, alpha olefins, benzyl alcohol, glycol ethers, and diols containing 6 to 16 carbon atoms.

6. The composition of claim 5 wherein said hydrophobic solvent (b) has the formula $R^1O\text{-}(R^2O)_mH$ wherein each $R^1$ is an alkyl group which contains from about 4 to about 8 carbon atoms, each $R^2$ is selected from the group consisting of ethylene or propylene, and m is a number from 1 to about 3.

7. The composition of claim 1 additionally containing alkanolamine selected from the group consisting of monoethanolamine, beta-aminoalkanol, and mixtures thereof.

8. The composition of claim 7 wherein said alkanolamine comprises monoethanolamine.

9. The composition of claim 5 wherein said hydrophobic solvent (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

10. The composition of claim 9 wherein said anionic detergent surfactant is selected from the group consisting of paraffin sulfonates, alkyl benzene sulfonates, and alkyl ethoxylate sulfates.

11. The composition of claim 5 wherein said anionic detergent surfactant is selected from the group consisting of paraffin sulfonates, alkyl benzene sulfonates, and alkyl ethoxylate sulfates.

12. The composition of claim 1 containing from about 1% to about 15% of said hydrophobic solvent (b) having the formula $R^1O\text{-}(R^2O)_mH$ wherein each $R^1$ is an alkyl group which contains from about 4 to about 8 carbon atoms, each $R^2$ is selected from the group consisting of ethylene or propylene, and m is a number from 1 to about 3.

13. The composition of claim 12 wherein said nonionic detergent surfactant has an HLB of from about 10 to about 14.

14. The composition of claim 13 wherein said anionic detergent surfactant is selected from the group consisting of paraffin sulfonates, alkyl benzene sulfonates, and alkyl ethoxylate sulfates.

15. The composition of claim 1 containing from about 1% to about 15% of said hydrophobic solvent (b), said hydrophobic solvent having a solubility in water of less than about 20%.

16. The composition of claim 1 wherein the level of said nonionic detergent surfactant is from about 2% to about 10%; the level of said hydrophobic solvent is from about 1% to about 12%; and the pH of said composition is from about 8.5 to about 11.5.

17. The composition of claim 16 wherein said anionic detergent surfactant is selected from the group consisting of paraffin sulfonates, alkyl benzene sulfonates, and alkyl ethoxylate sulfates.

18. The composition of claim 1 wherein said anionic detergent surfactant is selected from the group consisting of paraffin sulfonates, alkyl benzene sulfonates, and alkyl ethoxylate sulfates.

19. The composition of claim 18 wherein said anionic detergent surfactant is a paraffin sulfonate.

20. The process of cleaning hard surfaces comprising spraying said surfaces with the composition of claim 1.

* * * * *